United States Patent [19]

Phillips et al.

[11] Patent Number: 4,501,082

[45] Date of Patent: Feb. 26, 1985

[54] PORTABLE BENCH REST

[76] Inventors: F. Joseph Phillips, 313 Fourth Ave., Bradley Beach, N.J. 07720; Paul E. Phillips, 213 Laurel Pl., Neptune, N.J. 07752; Peter J. Phillips, 1902 B St., Belmar, N.J. 07719; Brian Phillips, 213 Laurel Pl., Neptune, N.J. 07753

[21] Appl. No.: 484,458

[22] Filed: Apr. 13, 1983

[51] Int. Cl.[3] ..... F41C 29/00

[52] U.S. Cl. ..... 42/94

[58] Field of Search ..... 42/94; 89/37 BA; 108/158, 155

[56] References Cited

U.S. PATENT DOCUMENTS

| | | | |
|---|---|---|---|
| 1,407,403 | 2/1922 | Garst | 108/158 |
| 2,615,770 | 10/1952 | Curtis | 108/155 |
| 2,834,644 | 5/1958 | Johansson et al. | 108/155 |
| 2,847,909 | 8/1958 | Kester | 42/94 |
| 3,711,984 | 1/1973 | Dyer et al. | 42/94 |
| 3,772,813 | 11/1973 | Sands | 42/94 |

*Primary Examiner*—Charles T. Jordan

*Attorney, Agent, or Firm*—James D. Hall

[57] ABSTRACT

A shooting bench including an upper cross member having legs pivotally attached thereto to allow for collapsing of the legs for carrying of the shooting bench. A brace secures one of the legs in an extended position during use of the bench. The other leg carries a rest member at its upper end which is adjustable for elevation by pivoting the leg about its pivotable attachment to the upper cross member.

3 Claims, 6 Drawing Figures

PORTABLE BENCH REST

SUMMARY OF THE INVENTION

This invention relates to a shooting bench intended primarily for use with a rifle, but which may be adapted to use with a pistol or other firearm.

Presently, shooting benches are cumbersome, large, and are usually firmly attached to the ground or a concrete platform. These features are thought to be desirable since they provide a steady, motionless, rest for the shooter. These rests are of little, or no utility in uses other than at a target or practice range. While other rests are designed for use in hunting or home practice situations, they do not provide the degree of support needed for accurate shooting and are cumbersome to transport.

Therefore, it is an object of this invention to provide a lightweight, self-supporting, portable bench rest which provides motionless support for the shooter. The bench rest of this invention includes a frame having an upper cross member and a pair of rigid legs pivotally attached to each end of the upper cross member. A brace member is pivotally secured at one end to the upper cross member and removably secured at its other end to one of the legs for rigidly positioning the legs during use of the bench rest. The other pair of legs remains pivotable during use of the bench rest to allow for adjustment of the elevation of a rest member which is carried above the upper cross member by a pair of legs. A platform is secured to the upper cross member for supporting the arms of the shooter and is adapted to be moved to accommodate right or left-handed shooters. Collapse of the bench rest for transportation is accomplished by removing the brace from securement with its connecting pair of legs and folding both legs and the brace about their respective pivots to underlie the upper cross member.

Accordingly, it is an object of this invention to provide a shooting bench rest which is lightweight and easily transportable.

Another object of this invention is to provide a bench rest which is rigid and steady during shooting but is easily collapsible for carrying.

Another object of this invention is to provide a bench rest which is rigid and steady during shooting and has a rest member which is adjustable in elevation.

Another object of this invention is to provide a bench rest which accommodates both left and right-handed shooters.

Other objects of this invention will become apparent upon a reading of the following specification.

BRIEF DESCRIPTION OF THE DRAWINGS

A preferred embodiment has been chosen for illustration and description wherein.

DESCRIPTION OF THE PREFERRED EMBODIMENT

Figure 1:
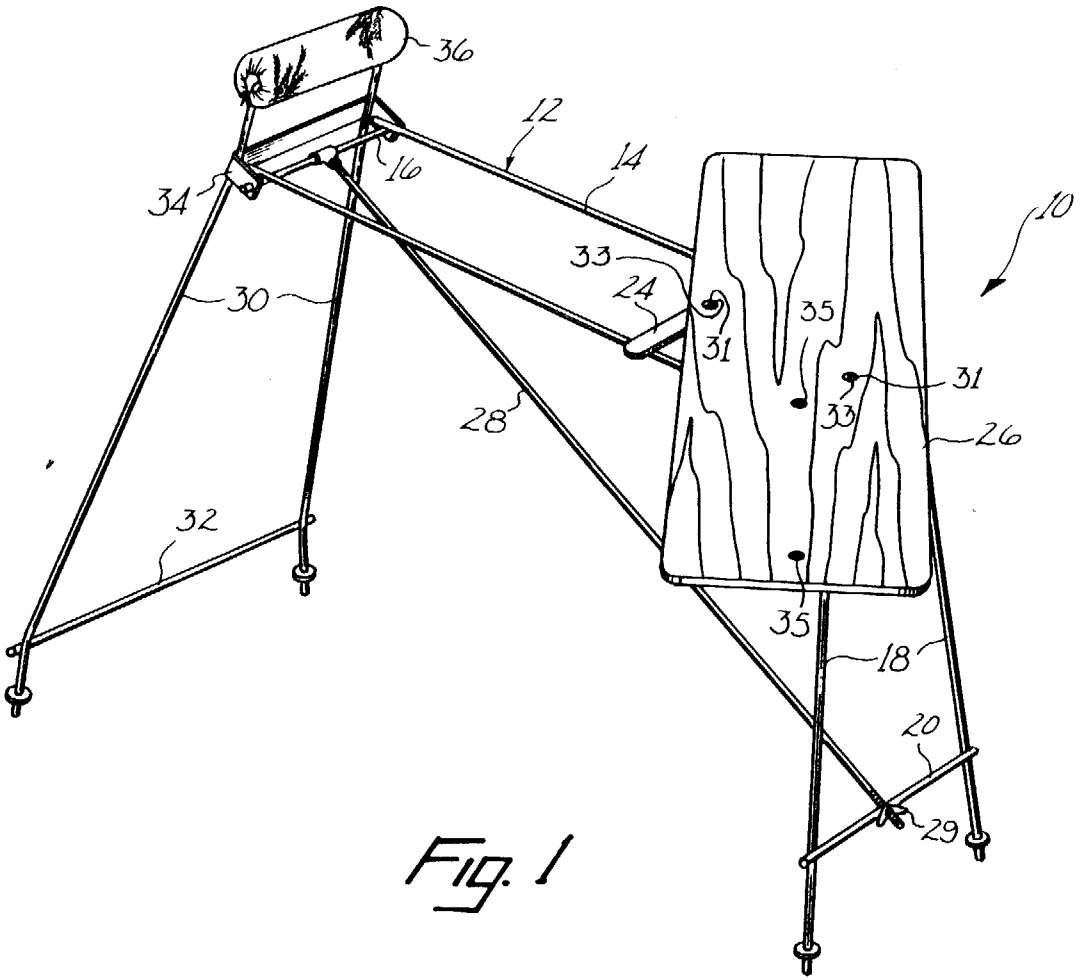
FIG. 1 is a perspective view of the bench rest shown set up for a left-handed shooter.

The preferred embodiment illustrated is not intended to be exhaustive or to limit the invention to the precise form disclosed. It is chosen and described in order to explain the principles of the invention and its application and practical use to thereby enable others skilled in the art to utilize the invention.

The bench rest 10 of this invention includes an upper cross member 12. Upper cross member 12 includes two longitudinal rods 14 joined at each of their ends by a lateral rod 16. Upper cross member 12 includes spaced transverse members 24 which extend across longitudinal rods 14 and are positioned between lateral rods 16. Transverse members 24 each have an opening 25. A pair of rear legs 18 extend from upper cross member 12 and are joined by a brace 20 at their lower ends and a bracket 22 at their upper ends. Bracket 22 is pivotally attached to the rear lateral rod 16 of upper cross member 12. A pair of front legs 30 extend from upper cross member 12 and are joined at their lower ends by a cross brace 32 and near their upper ends by a bracket 34. Bracket 34 is pivotally attached to the forward lateral rod 16 of upper cross member 12. The upper ends of legs 30 extend beyond brace 32 and carry a padded rest member or support 36. A longitudinal brace rod 28 is pivotally secured at one end to the front lateral rod 16 and is removably fastenable at its other end to cross brace 20 for rear legs 18 by projecting through the cross brace and secured thereto by a wing nut 29. A platform 26, which is preferably of a wood or plastic construction, is secured by bolts 31 to transverse members 24 through openings 25.

Figure 2:
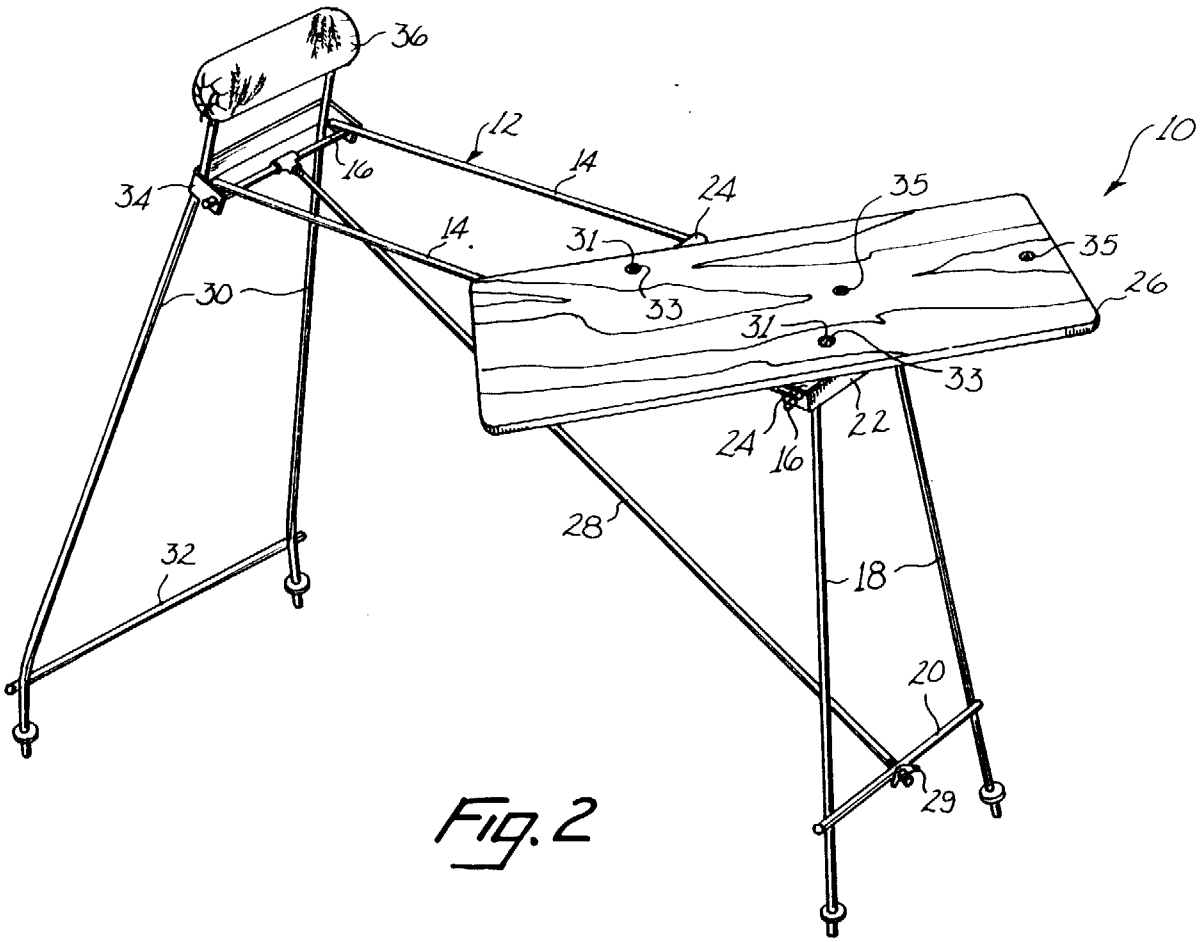
FIG. 2 is a perspective view of the bench rest shown set up for a right-handed shooter.
Figure 3:
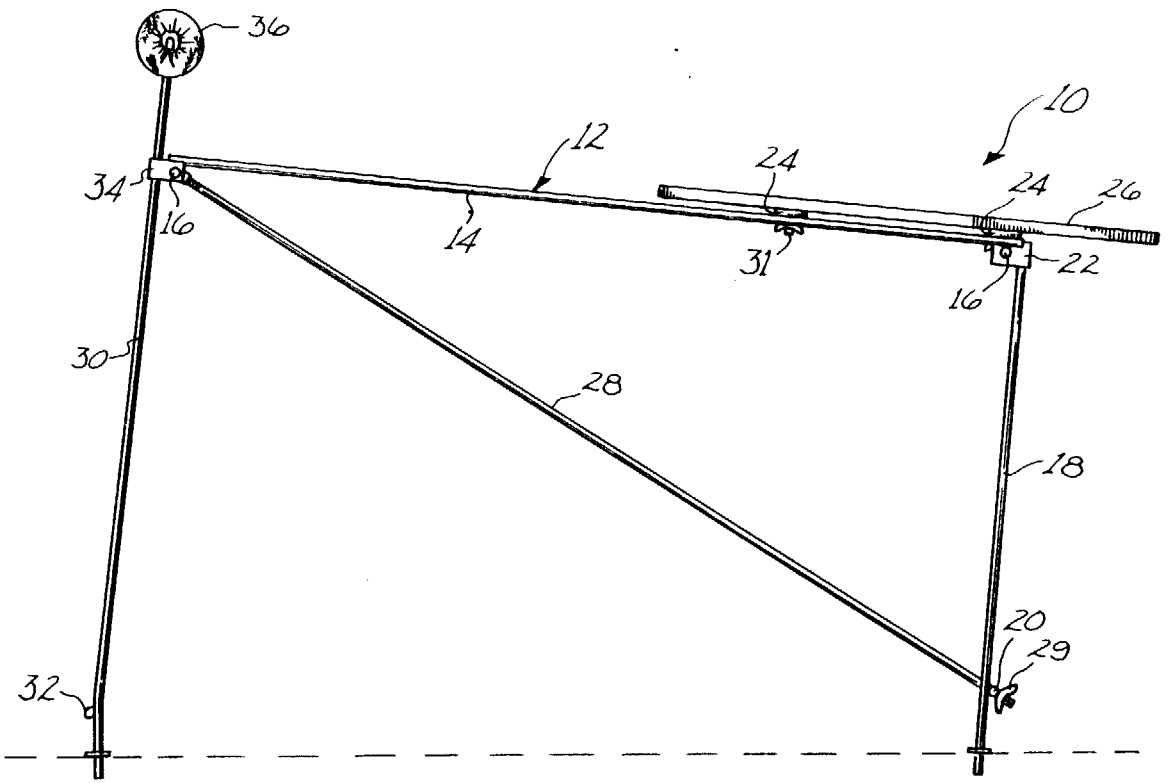
FIG. 3 is a side view of the bench rest showing its gun rest member in a maximum elevation.
Figure 4:
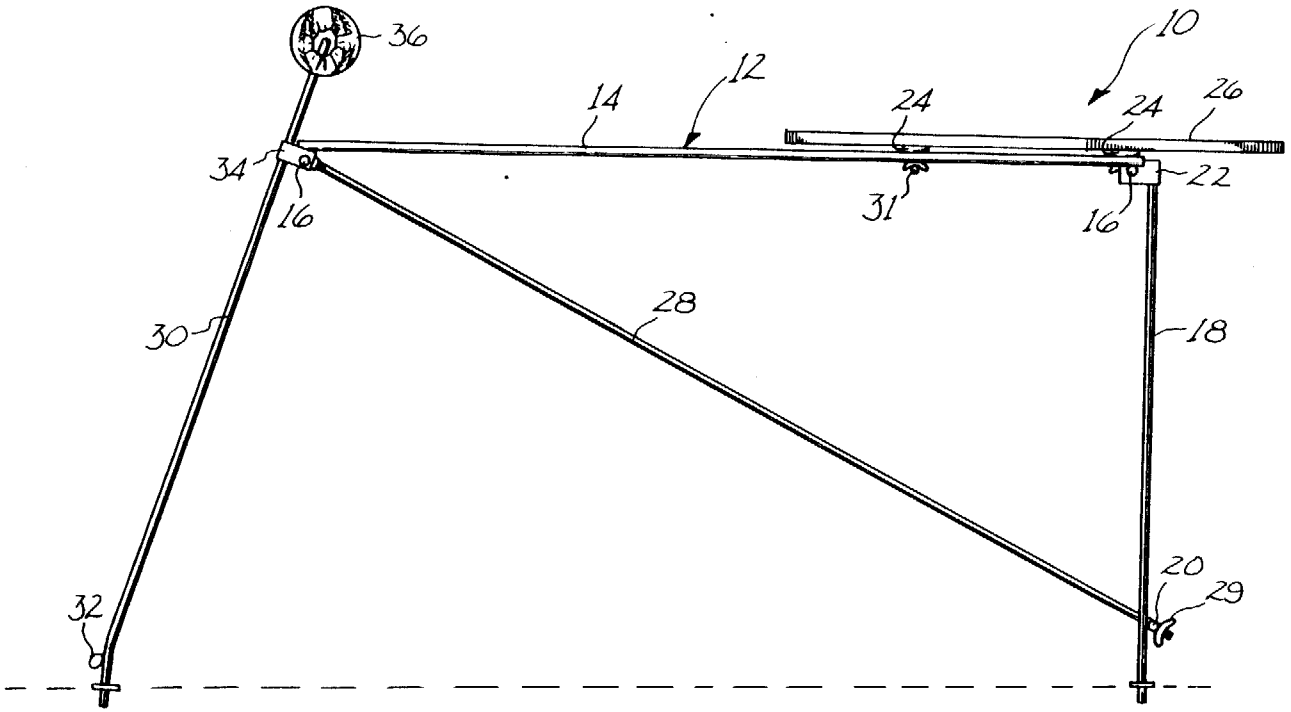
FIG. 4 is a side view of the bench rest showing its gun rest member in a lower elevation.
Figure 5:
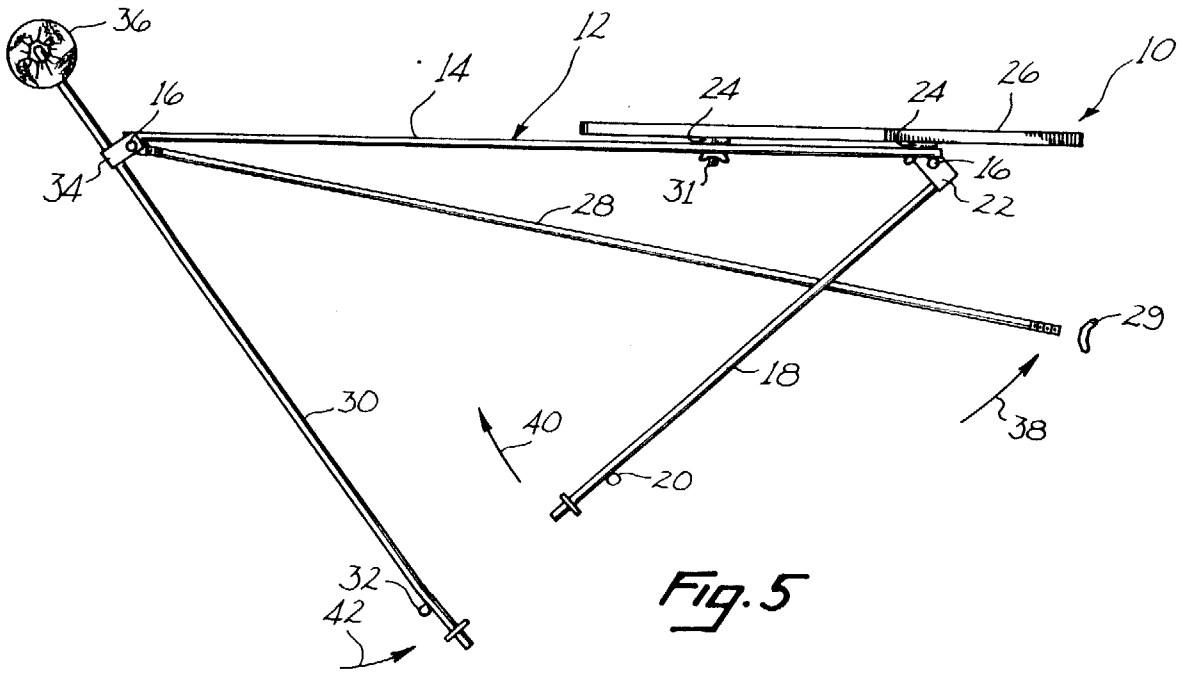
FIG. 5 is a side view of the bench rest showing detachment of the brace from one pair of the legs and folding of the legs and brace into their collapsed position.
Figure 6:
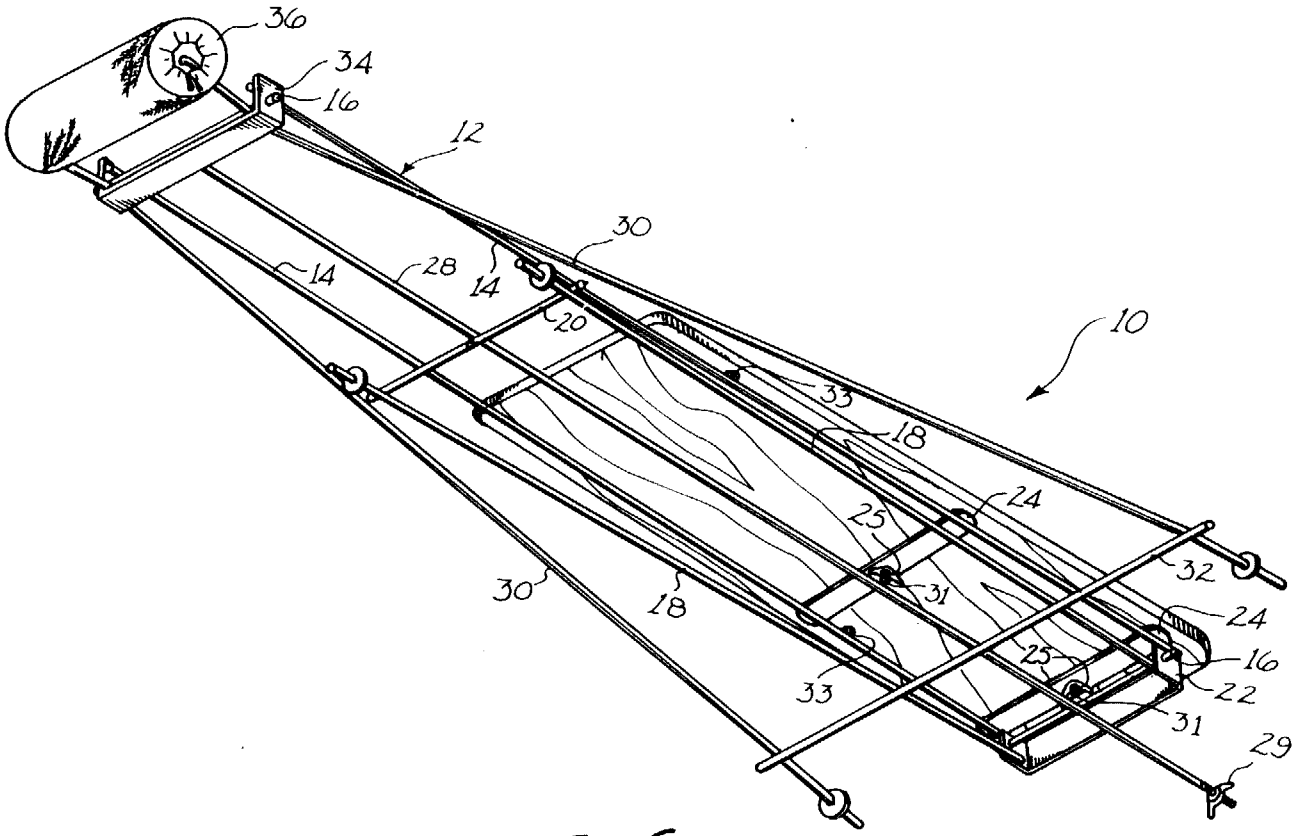
FIG. 6 is a bottom view of the bench rest shown in its folded form.

In the use of bench rest 10, legs 18 and 30 are placed in extended positions such as shown in FIGS. 1–4. Legs 18 are retained in their extended position by the securement of brace rod 28 to lateral cross brace 20 of legs 18. Front legs 30 remain pivotal about forward lateral rod 16 of cross member 12 to provide for adjustment of the elevation of support 36 as seen by comparison of FIGS. 3 and 4. With legs 18 and 30 in their extended positions, the shooter sits adjacent to bench rest 10 with his elbows and forearms resting upon platform 26 and the barrel, or stock, of the rifle resting upon support 36. Platform 26 may be removed from cross member 12 and reversed in position for use by either a left or right-handed shooter as seen in FIGS. 1 and 2. This reversibility is accomplished by the location of the bolt mounting openings 33 in the platform. When the use of bench rest 10 is completed, the bench rest may be collapsed for transportation as illustrated in FIGS. 5 and 6 by removing wing nut 29 from brace rod 28 and detaching the brace rod from cross brace 20. When so disconnected, brace 28 may be folded inwardly as indicated by arrow 38 in FIG. 5 to overlie upper cross member 12. Legs 18 and 30 may be folded inwardly as indicated by arrows 40 and 42 in FIG. 5 to also overlie upper cross member 12 to provide a flat, compact and lightweight object for carrying from and to the shooting site. For ease of storage, platform 26 may be detached and reconnected by bolts 31 through platform openings 35 and transverse member openings 25 as seen in FIG. 6.

It is to be understood that this invention is not to be limited by the terms of the above description but may be modified within the scope of the appended claims.

We claim:

1. A shooting bench comprising a frame which includes an upper cross member and leg means pivotally connected at each end of said cross member, said leg means each being shiftable about its pivot connection to said cross member between a collapsed position overlying the cross member and an extended position depending from the cross member, said leg means for supporting said cross member upon the ground in a rigid position when in said extended positions, rest means carried by one of said leg means positionable above said cross member when said one leg means is shifted into its said extended position for supporting a rifle or similar device, a brace removably connected between said cross member and a said leg means when in its said extended position, and platform means secured to said cross member for supporting the arms of the rifle user, said platform means including a plurality of selectively spaced openings, said upper cross member having openings formed therein alignable with at least two of said openings formed in said platform means depending upon the desired angular orientation of the platform means in a generally horizontal plane relative to the upper cross member, securing members extending through said aligned openings in the upper cross member and platform means for securing the platform means to the cross member in said desired angular orientation.

2. The shooting bench of claim 1 wherein said brace is connected between said cross member and the other of said leg means, whereby said one leg means is pivotable about its pivot connection to said cross member when in its extended position for adjusting the elevation of said rest means.

3. The shooting bench of claim 1 wherein said rest means is carried by said one leg means at one end of said cross member and said platform means is secured to the cross member adjacent its other end.

* * * * *